United States Patent [19]

Witty

[11] 3,937,370

[45] Feb. 10, 1976

[54] CONTROLLED DEPTH ASPIRATION CANNULA

[75] Inventor: Michael E. Witty, El Toro, Calif.

[73] Assignee: Baxter Laboratories, Inc., Deerfield, Ill.

[22] Filed: Aug. 14, 1974

[21] Appl. No.: 497,421

[52] U.S. Cl. ..... 222/464; 222/382; 137/152

[51] Int. Cl.[2] ..... B67D 5/60

[58] Field of Search..... 222/464, 416, 382; 141/21–24; 210/DIG. 23, 65, 83; 239/33; 215/DIG. 3, 1 A, 4; 23/259, 258.5; 137/152, 153; 141/391

[56] References Cited

UNITED STATES PATENTS

| | | | |
|---|---|---|---|
| 388,239 | 8/1888 | Arnold et al. | 215/3 |
| 647,344 | 4/1900 | Waynick | 222/464 |
| 929,990 | 8/1909 | Shields | 215/3 |
| 1,468,887 | 9/1923 | Sterrick | 137/152 X |
| 3,372,846 | 3/1968 | Berkus | 222/525 X |
| 3,411,648 | 11/1968 | Tichy | 137/152 X |

*Primary Examiner*—Allen N. Knowles

[57] ABSTRACT

A controlled depth fluid aspiration cannula is disclosed comprising an elongated tubular member terminating at the distal end with a wall and terminating at the proximal end with attachment means to provide a sealing fitment for a flexible conduit. Radially disposed orifices are positioned near the distal end, and a radially extending flange is positioned between the ends of the tubular member to provide controlled depth aspiration of fluid.

3 Claims, 8 Drawing Figures

FIG. 1.
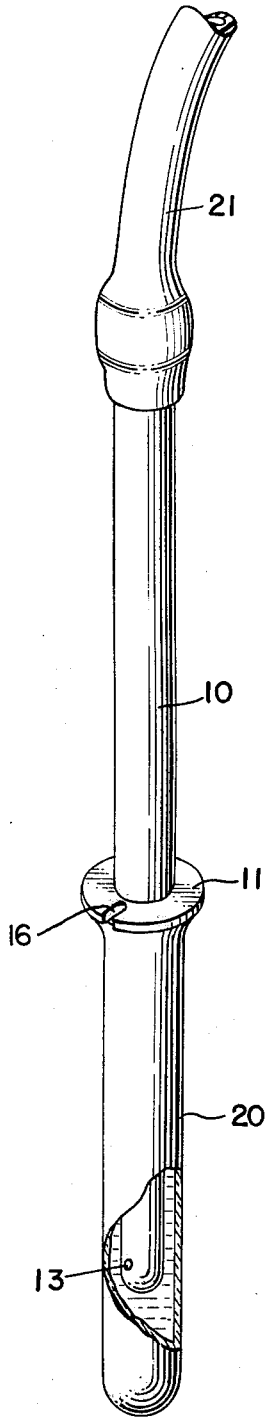
FIG. 2.
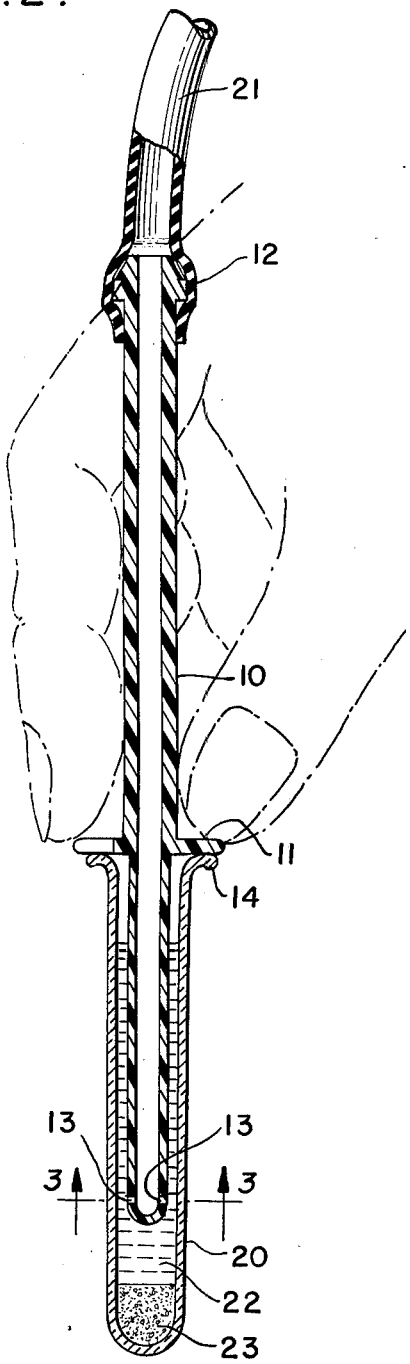
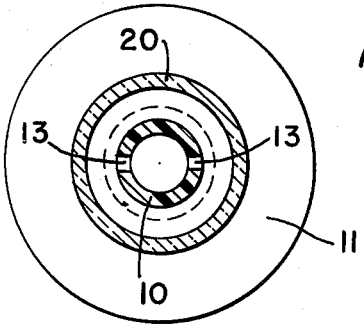
FIG. 3.

CONTROLLED DEPTH ASPIRATION CANNULA

BACKGROUND OF THE INVENTION

Clinical chemistry of modern vintage is designed to undertake a maximum number of tests. These tests are conducted on hundreds of similar samples. It is often necessary in this testing, to aspirate fluid from open mouthed elongated receptacles containing these samples. In the case of aspirating liquid from a two phase liquid-solid system, such as centrifuged blood or other similarly treated biological specimens, it is important to prevent the removal of any of the solid phase from the receptacle, particularly where testing is to be conducted on the solid phase.

OBJECTS OF THE INVENTION

Accordingly, it is an object of the present invention to provide an improved aspiration cannula for accurately aspirating liquid from an open mouthed receptacle containing a two phase liquid-solid system.

It is a further object of this invention to provide an aspiration cannula which extends into a test tube to a controlled depth to provide, accurate, repeatable, and rapid aspiration of a large number of identical test tubes.

SUMMARY OF THE INVENTION

An aspiration cannula has now been developed which accurately aspirates substantially all the fluid from an open mouth receptacle and does not disturb any solid phase which may be at the bottom of the receptacle. The aspiration cannula comprises a tubular member having a wall at the distal end. Attachment means adapted to provide a sealing fitment for a flexible conduit leading to a vacuum line is provided at the proximal end of the tubular member. Vacuum orifices are provided in the side of the tubular member near the distal end; the side location of these orifices reduces the amount of agitation in the receptacle during aspiration, which is important when aspirating a liquid-solid system in order to prevent removal of any of the solid phase from the test tube. A built in stop in the form of a radially extending flange is disposed intermediate the ends of the tubular member. The portion of the tubular member above the radially extending flange is held by the laboratory technologist; if desired, this portion can be of larger diameter and/or longer than the portion of the tubular member below the radially extending flange for greater convenience in holding the aspiration cannula.

In another embodiment, the aspiration cannula is constructed of two parts which mate together to form the complete aspiration cannula. The upper part includes the radially extending flange and a centrally positioned socket axially disposed in said part. The lower part having the end wall or tip, is adapted and constructed to have a portion thereof frictionally fitted in the socket of the upper part remote from the end wall portion. The lower part can be retained in the upper part more securely by detent means.

The aspiration cannula of the present invention is most readily mass produced by plastic injection molding. A wide variety of plastics can be used to make the aspiration cannula of the present invention, although polyolefins such as polyethylene and polypropylene are particularly suitable. The length of the portion of the aspiration cannula that projects into the receptacle can be varied with the type of receptacle which is to be used and the amount of solid matter in said receptacle.

BRIEF DESCRIPTION OF THE DRAWINGS

The invention and its various modifications will be more fully understood when reference is made to the figures of the accompanying drawings in which:

FIG. 1 is a perspective view of the aspiration cannula of the present invention in use in a test tube and connected to a vacuum line.

FIG. 2 is a side elevational view of FIG. 1 in cross-section.

FIG. 3 is a view of FIG. 2 taken along line 3—3.

DETAILED DESCRIPTION OF THE INVENTION

Figure 5:
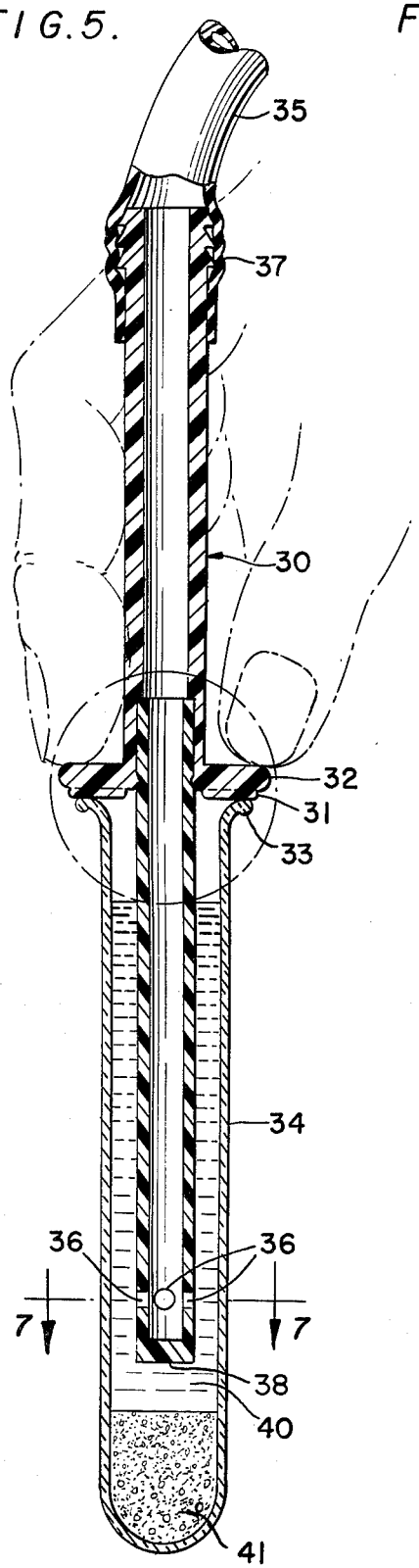
FIG. 5 is a cross-sectional view of FIG. 4 taken along line 5—5.

Now, with reference to the drawings, FIG. 1 shows a one piece aspiration cannula comprising tubular member 10 which is inserted in test tube 20. Tubular member 10 is provided with radially extending flange 11 which rests on the lip (not shown) of the test tube and prevents the aspiration cannula from being inserted into said test tube beyond a predetermined depth. A vacuum orifice 13 is shown on the side near the bottom wall of the tubular member 10. The flexible conduit 21 leading to a vacuum line is connected at the top of the tubular member 10. Slot 16 prevents radially extending flange 11 from completely covering the mouth of test tube 20 and creating a vacuum inside said tube while being aspirated.

FIG. 2 is a cross-sectional view of the aspiration cannula being manually held in a test tube for aspiration of supernatant liquid from the packed solid phase. The radially extending flange 11 of the tubular member 10 rests on the lip 14 of the test tube 20 and prevents the aspiration cannula from being inserted into the solid phase 23 in the test tube. The liquid 22 in the test tube is withdrawn through the vacuum orifices 13 on the side near the tip of the tubular member. The flexible conduit 21 is retained on the aspiration cannula by flanges 12 at the top of the tubular member.

FIG. 3 is a section of the aspiration cannula of FIG. 2 taken along line 3—3 showing the radially extending flange 11 and the oppositely disposed vacuum orifices 13.

A preferred embodiment of the invention is shown in FIGS. 4 to 7. In this embodiment, rib members 31 depend downwardly from the radially extending flange 32 of the tubular member 30. These rib members 31 prevent the radially extending flange 32 from completely closing the mouth 33 of the receptacle 34 and creating a vacuum inside the receptacle when the vacuum line is in operation. Flanges 37 provide means for retaining a flexible conduit 35 leading to a vacuum line. The vacuum orifices 36 are located on the side near the bottom wall of the tubular member 30.

In the embodiment of FIGS. 4 to 7, end wall 38 at the tip of the tubular member 30 is flat rather than rounded as in the embodiment of FIGS. 1 to 3. When the outside diameter of the tubular member 30 is almost as great as the inside diameter of receptacle 34, a rounded tip is conducive to air currents, created by the vacuum orifices 36, flowing past the orifices and causes undesirable agitation of the solids in the two phase liquid-solid system. It has been found that the flat configuration of end wall 38 uniquely eliminates this solid phase agitation when the outside diameter of the tubular member and the inside diameter of the receptacle are close in size.

Figure 4:
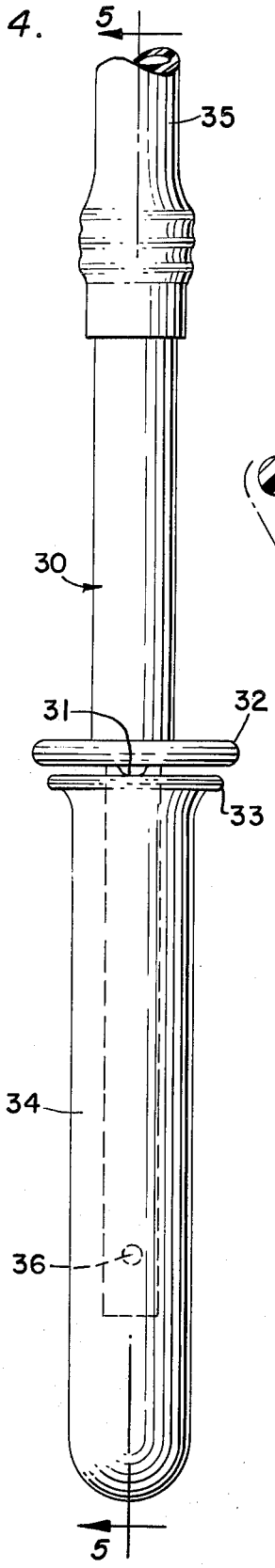
FIG. 4 is a side elevational view of a two-part aspiration cannula in use in a test tube.

FIG. 5 is a cross-sectional view of FIG. 4 taken along line 5—5. In this view, the laboratory technologist's fingers rest on the radially extending flange 32 from which members 31 depend downwardly to rest on the lip 33 of the test tube 34. The radially extending flange also serves to ensure that the aspiration cannula is inserted into the receptacle to a predetermined depth so that substantially all the fluid phase 40 can be aspirated but whereby the vacuum orifices 36 remain in contact only with the fluid phase 40 in the receptacle and do not contact the solid phase 41 in the bottom of the receptacle.

Figure 6:
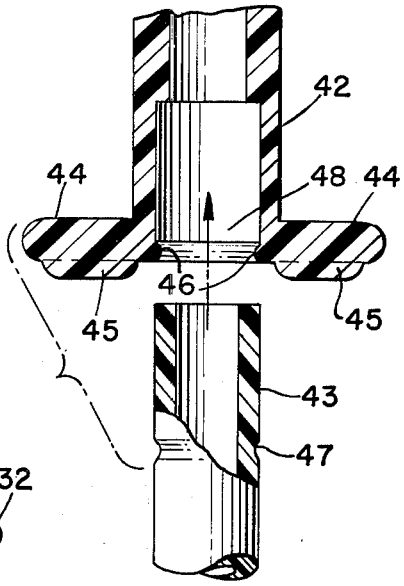
FIG. 6 is a breakaway view of the two separate parts of the aspiration cannula.

FIG. 6 shows a breakaway view of the two separate parts of a two part aspiration cannula. The upper part 42 carries the radially extending flange 44 from which members 45 depend downwardly to prevent complete coverage of the mouth of the receptacle. The socket 48 receives the lower part 43 of the aspiration cannula, and detent means 46 are provided to hold the lower part securely. The lower part 43 carries the end wall portion (not shown) and vacuum orifices (not shown). Means 47 are provided to receive the detent means 46 of the upper part.

Figure 7:
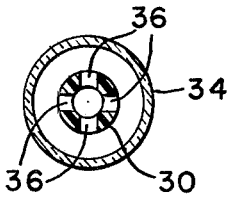
FIG. 7 is a view of FIG. 5 along line 7—7.

FIG. 7 is a view of FIG. 5 taken along line 7—7. The lower part of the tubular member 30 carries the four equally circumferentially spaced vacuum orifices 36.

In use, a flexible conduit leading to a vacuum line is connected to the aspiration cannula and retained by attachment means near the top of the aspiration cannula. The laboratory technologist grasps the top of the aspiration cannula, using the radially extending flange as a support for the fingers, and inserts it into an open mouthed receptacle containing the two phase liquid-solid system in which the solid phase is at the bottom of the receptacle. The radially extending flange is important to maintain the tip of the aspiration cannula above the level of the solid phase in order to remove substantially all the fluid phase without disturbing the solid phase. The radially extending flange conveniently rests on the lip of the receptacle. When the vacuum line is turned on, fluid is withdrawn from the receptacle through the vacuum orifices.

Figure 8:
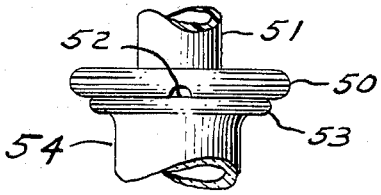
FIG. 8 is a fragmentary front elevational view of another embodiment of the present invention.

FIG. 8 illustrates still another embodiment of the present invention in which flange 50 disposed intermediate the ends of tubular member 51 is provided with groove 52 to prevent complete coverage of the mouth 53 of receptacle 54.

In the preferred embodiments of the invention, the radially extending flange has means disposed thereon in confronting abutment with the mouth of the receptacle to prevent the flange from completely covering the mouth of said receptacle. These abutment means, which can be downwardly depending rib members, an upwardly depending groove or a slot extending through the flange, as described above, will prevent complete coverage of the mouth of the receptacle so that a vacuum will not be formed in the receptacle when the vacuum line connected to the aspiration cannula is in operation. If a vacuum is formed in the receptacle, the [illegible] will be broken when the aspiration cannula is [illegible]ved and any solids in the bottom of the receptacle may be disrupted, to the detriment of further testing of the solids.

It will be appreciated that the invention as described can be further modified to meet the requirements of specific testing procedures. Still other modifications, adaptations, and alterations which will become apparent to those of ordinary skill in the art are possible within the spirit and the scope of the invention.

What is claimed is:

1. An aspiration cannula for aspirating fluids from an open mouthed elongated receptacle comprising:

a. an elongated tubular member terminating at one end portion with a wall;

b. said tubular member being constructed of a first part and a second part;

c. said first part including a radially extending flange for controlled depth aspiration of said receptacle and a centrally positioned socket axially disposed therein;

d. said second part having said end wall portion and being adapted and constructed to have a portion thereof located in said socket remote from said end wall portion;

e. said tubular member having a plurality of orifices circumferentially positioned substantially at the end portion of the tubular member having said end wall;

f. said first part terminating at the end remote from said radially extending flange with attachment means adapted and constructed to provide a sealing fitment for a flexible conduit;

g. means for preventing said radially extending flange from completely covering the mouth of said open mouthed elongated receptacle.

2. The aspiration cannula of claim 1 wherein said second part is retained in said socket by detent means.

3. The aspiration cannula of claim 1 wherein said end wall is flat.

* * * * *